United States Patent [19]

Williamson et al.

[11] Patent Number: 4,899,505

[45] Date of Patent: Feb. 13, 1990

[54] ROOF VENTILATOR

[75] Inventors: Jerry Williamson, Canby, Oreg.; Keith Muters, 2831 N. Willis Rd., Portland, Oreg. 97217

[73] Assignee: Keith Muters, Rohnert Part, Calif.

[21] Appl. No.: 417,368

[22] Filed: Sep. 13, 1982

[51] Int. Cl.[4] ..... E04B 7/00

[52] U.S. Cl. ..... 52/199; 98/42.22

[58] Field of Search ..... 52/199, 95, 473, 303; 98/42 R, 42 A, 121 R

[56] References Cited

U.S. PATENT DOCUMENTS

| | | | |
|---|---|---|---|
| Re. 25,921 | 11/1965 | Smith | 98/42 A |
| 2,579,662 | 12/1951 | Gibson | 98/42 R |
| 2,839,986 | 6/1958 | Herman | D23/153 X |
| 2,954,727 | 10/1960 | Katt et al. | 52/199 X |
| 2,973,704 | 3/1961 | Flanagan | 98/42 |
| 3,203,079 | 8/1965 | Smith et al. | 98/121 R X |
| 3,895,467 | 7/1975 | Clement | 98/42 X |
| 4,007,672 | 2/1977 | Luckey | 52/95 X |
| 4,102,090 | 7/1978 | Anguish | 52/199 X |

FOREIGN PATENT DOCUMENTS

| | | | |
|---|---|---|---|
| 237960 | 1/1965 | Austria | 98/42 |

*Primary Examiner*—Carl D. Friedman

*Attorney, Agent, or Firm*—T. W. Secrest

[57] ABSTRACT

This invention is directed to ventilators for a roof. In fact, there is disclosed two ventilators, an eave ventilator and a ridge ventilator. Each of the ventilators can be of unitary construction and formed from plastic. The ventilators allow air circulation in the attic of a building or a house so as to maintain cool air in the attic. The result is an increase in the longevity of the structure of the house.

9 Claims, 9 Drawing Sheets

Fig 12
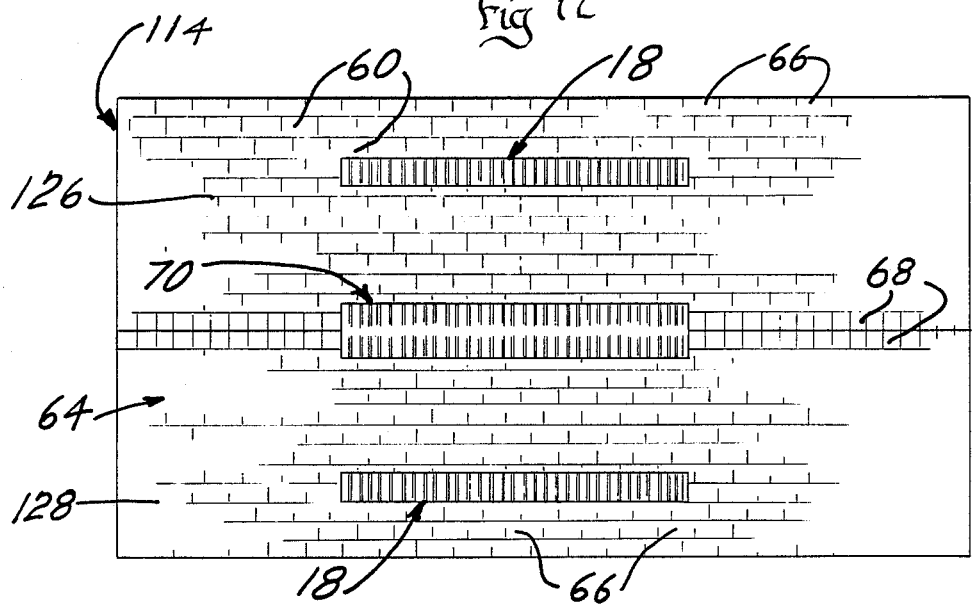
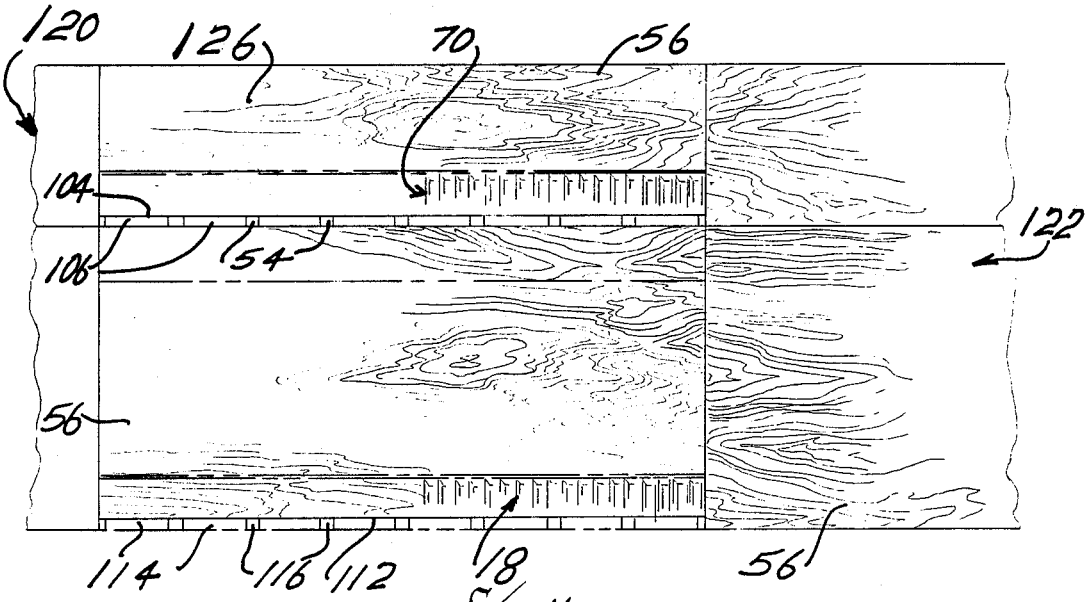
Fig 11

ROOF VENTILATOR

THE BACKGROUND OF THE INVENTION

In a building having a pitched or sloping roof, there is often an attic. An example of this is a house, a garage, or a shop. In a house, and above the ceiling, there is an attic. In many houses there is a dead air space above the ceiling and below the roof or the sheeting for the roof. In the attic there is a dead air space because of no circulation or only a small amount of circulation.

In the summer there is a build-up of heat in the attic or an increase in the temperature in the attic. If there be a high humidity, then the rafters and ridgeboard in the attic may rot. In fact, the wooden trusses in the attic and even the sheeting for the roofing material may rot.

It is well known that the attic should be cool. A cool attic will help perserve the rafters, ridgeboards and wooden trusses.

Above the ceiling there can be placed insulation so that there is only a minimum of heat loss through the ceiling. However, above the insulation there should be air circulation so as to allow the attic to be cool. With air circulation there is a less possibility of an increase in temperature in the attic and build-up of heat. Also, with air circulation there is less possibility of an increase in humidity in the air in the attic.

In many of the older residential houses, there was no provision for air circulation in the attic. The air was trapped between the ceiling of the room, the sheeting underlying the roofing material and the ends of the residential house. As a result, in the summertime, there would be an increase in the temperature in the attic and there would be a possibility of the combination of the higher temperature and the humidity in the air for some rot to take place in the wooden trusses, rafters or ridge boards.

There have been many inventions in recent years relating to solving the problem of air circulation in the attic. In preparing this patent application, a patent search was made. The patents found in this patent search were four. One of these patents is Maze, U.S. Pat. No. 4,109,433, issuing date of 29, Aug. 1978. Maze teaches of a sheeting. There is an opening in the sheeting between rafters. There is an arcuate dome over the openings and screens over the ends of the arcuate dome. There is a funnel under the sheeting. This funnel leads upwardly toward the ridge of the roof. The funnel is supposed to conduct hot air near the ridge of the roof to the opening and out through the arcuate dome. Maze lists a number of patents cited in the prosecution of the patent application. In the Maze patent there are many separate parts. The separate parts must be assembled into the roof ventilator. It is expensive to assemble these separate parts into an appropriate roof ventilator.

Flanagan, U.S. Pat. No. 2,973,704, issue date of 7, Mar. 1961, teaches of a roof ventilator. This roof ventilator fits flush on a sloping roof. There are a number of inverted louvers. These louvers are directed upwardly. Underneath the louvers there is a bottom 20 which slopes downwardly. It is possible for air to enter into the space above the bottom 20 and below the louvers. The air can pass out through the louvers so there is air circulation. If water happens to pass through the louvers, the water drops onto the bottom 20 and flows downwardly and onto the roof. Again, Flanagan teaches of a complicated roof ventilator having many separate parts. There parts must be assembled into the roof ventilator. It is expensive to assemble the parts into the roof ventilator.

Katt et al, U.S. Pat. No. 2,954,727, issuing date of 4, Oct. 1960, teaches of a roof ventilator. There is an opening in the roof deck. The hood 15' covers the opening in the roof deck. There are downwardly directed louvers, having a screen 18 to keep out undesirable objects such as leaves, birds, small rodents and the like. Again, the hot air in the atitc flows upwardly and can pass through the opening in the roof and out of the roof ventilator so that there is air circulation in the attic. Again, Katt teaches of a complicated roof ventilator having many separate parts. It is necessary to assemble this roof ventilator. The assembling of the roof ventilator is expensive.

There is a patent Farren, U.S. Pat. No. 2,624,298, issuing date of 6, Jan. 1953. The reference Farren teaches of a tile roof structure having roof tile 10. There are openings in the roof tile to allow air to enter underneath the roof tile and flow upwardly over the underlying roof sheeting. Then, the air in flowing upwardly can flow out through an opening in a part near the upper tiles so as to allow air circulation over the roof sheeting and underneath the tile. It is to be noted that Farren does not teach of ventilation of an attic.

There are many types of roofs. A common type of roof is a roof having a ridge board and rafters. This is a sloping roof. If there is no means for allowing circulation of air in the attic underneath the roof there is a build-up of heat and an increase in the temperature of the air in the attic.

A second type of roof is a sloping roof using a truss for supporting the roof. The comments with respect to a ridge roof and a ridge board are also applicable with respect to a truss roof.

A third type of roof is a shed roof. With a shed roof there should be a means to allow the circulation of air in the attic in that space above the ceiling and below the shed roof.

It is desirable to prevent the accumulation and build-up of moisture in an attic. One of the ways to solve this is to have attic with air circulation in the attic. With adequate air circulation it is desirable to prevent air turbulance in the air in the attic. By allowing a reasonable amount of air to enter the attic and to leave the attic air turbulance can be prevented and also there can be achieved an adequate circulation of air in the attic.

One of the deleterious effects of moisture in air in the attic, a mixture of air and water vapor, is the reduction of the effectiveness in insulation. If there is too great an amount of moisture in the air in the attic, the insulation above the ceiling is not effective and there is a greater heat loss.

A BRIEF DESCRIPTION OF THE INVENTION

This invention is directed towards a ventilator to enhance the air circulation in the attic of a building. In fact, this invention teaches of two species of an air ventilator. A first species teaches of one set of openings and a second species teaches of two sets of openings in the ventilator.

The ventilator teaching of one set of openings can be used as an eave vent or a ridge vent.

The ventilator having two sets of openings is normally used as ridge vent.

If it is possible to have one or more eave vents and one or more ridge vents, then the cool air can enter at the eave and upon being heated will rise and pass out through the openings in the ridge vent so as to realize an adequate flow of air in the attic. With an adequate flow of air in the attic the temperature in the attic is maintained at a lower temperature as compared with still air in the attic. Also, there is less possibility of build-up of moisture and humidity in the air. The beneficial effect of the flow of air in the attic is to have a cooler attic in the summertime and a more enjoyable house in which to live.

The ventilators of this invention are plastic ventilators. They are a one piece ventilator and can be vacuum formed or vacuum molded.

The ventilator having one set of openings may be approximately one fourth of an inch thick, eighteen inches wide, and about forty-eight inches long. This ventilator, being of plastic, is flexible and can be bent to a modest degree.

The ventilator having two sets of openings is of a plastic which is about one fourth inch thick. The width of this ventilator is approximately thirty six inches and has a length of about forty-eight inches. Again, the plastic is flexible and the ventilator is flexible. The ventilator can be bent and curved so it is positioned over the ridge of the roof with one part of the ventilator on one sloping surface of the roof and the other part of the ventilator on the other sloping surface of the roof. The ventilator can be bent so as to have an inside angle of 90° and maybe an inside angle of 120°.

With an eave ventilator having one set of openings, and with a ridge ventilator having either one set of openings or two sets of openings it is possible for the air to enter into the eave ventilator and pass out through the ridge ventilator. The beneficial effects of such ventilation are desirable as the attic is cooler and there is less possibility of build-up of moisture and temperature and rotting of the wood in the rafters, trusses and the like.

THE DRAWINGS

Figure 3:
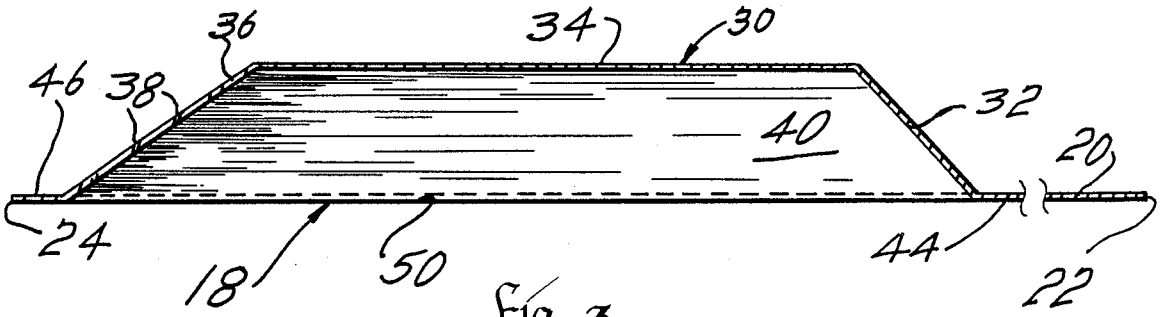
Figure 4:
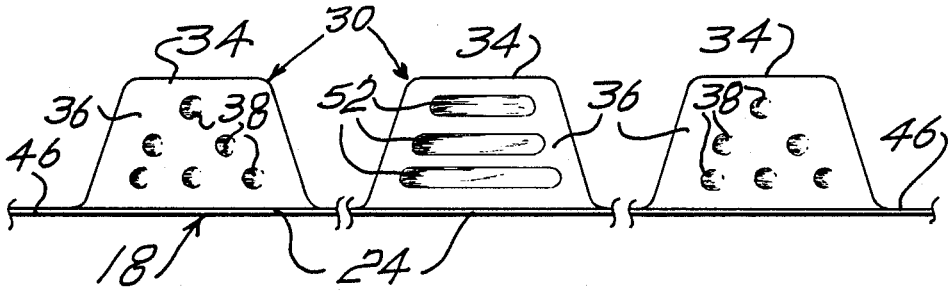
Figure 5:
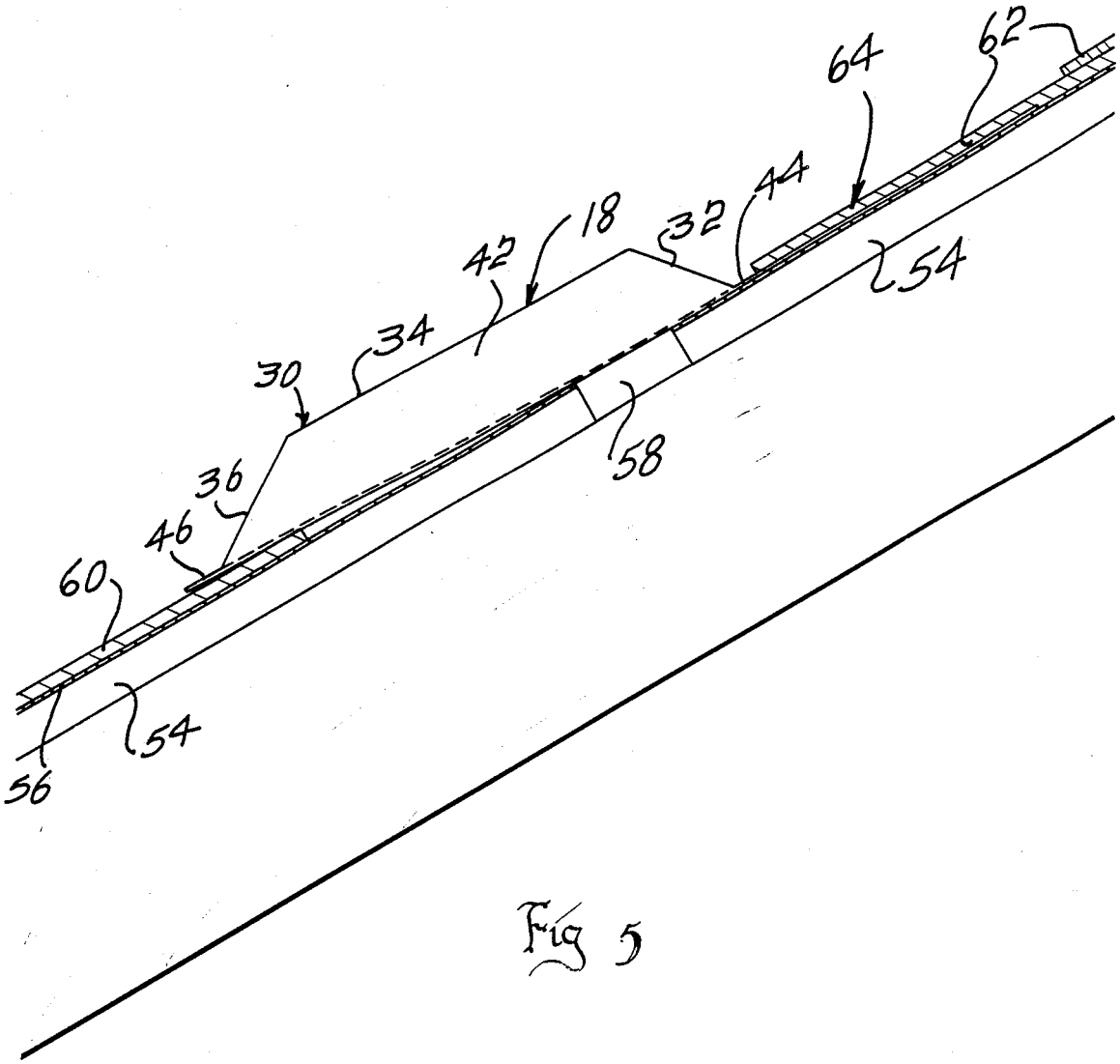
Figure 6:
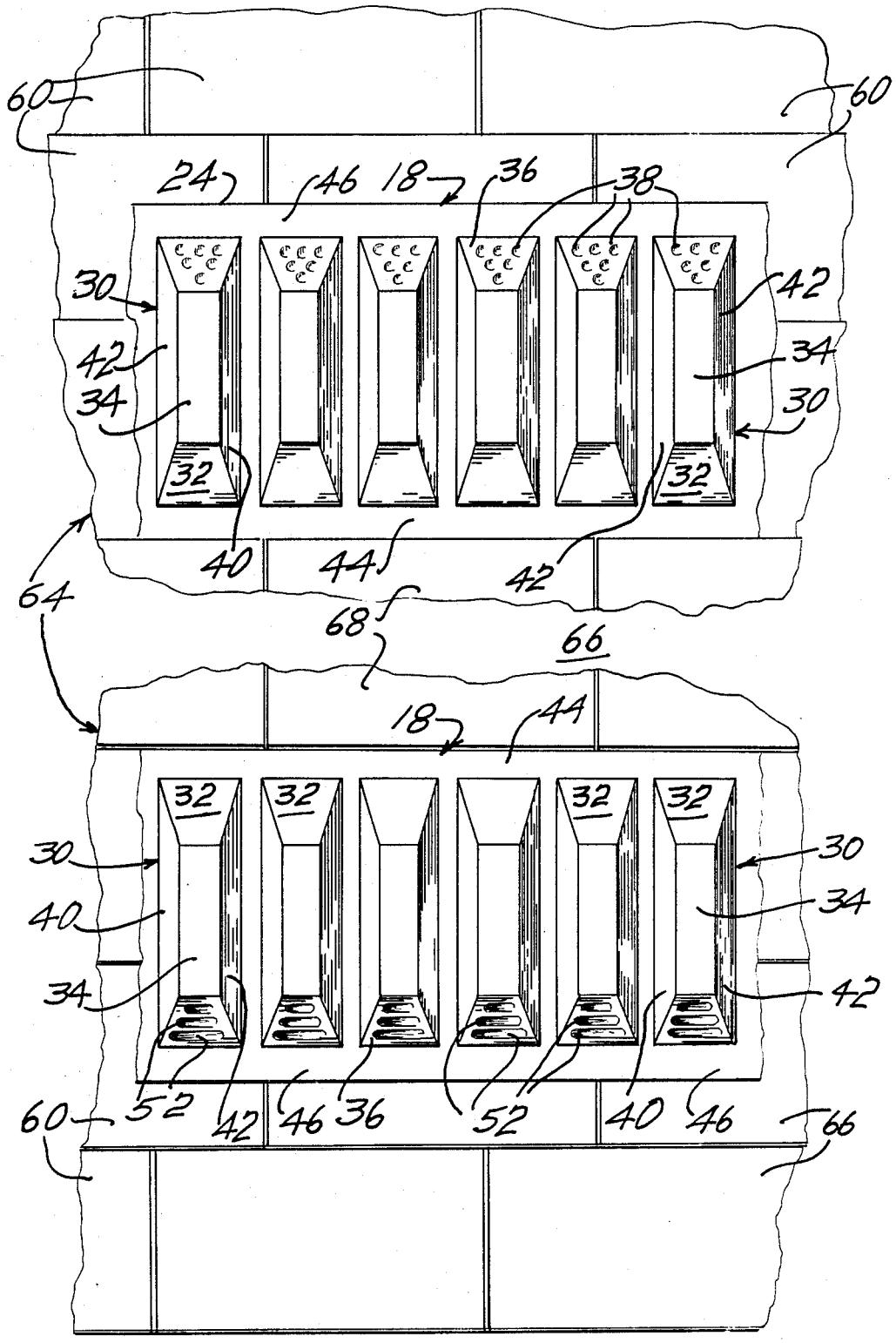
Figure 7:
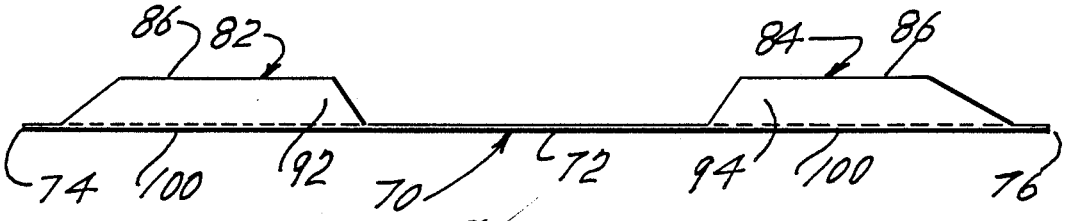
Figure 8:
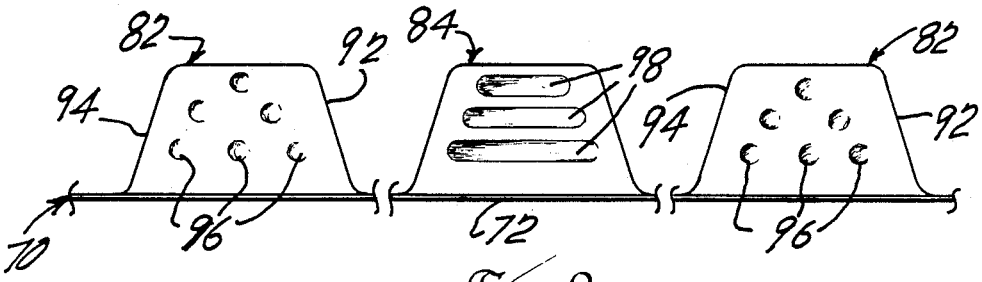
Figure 9:
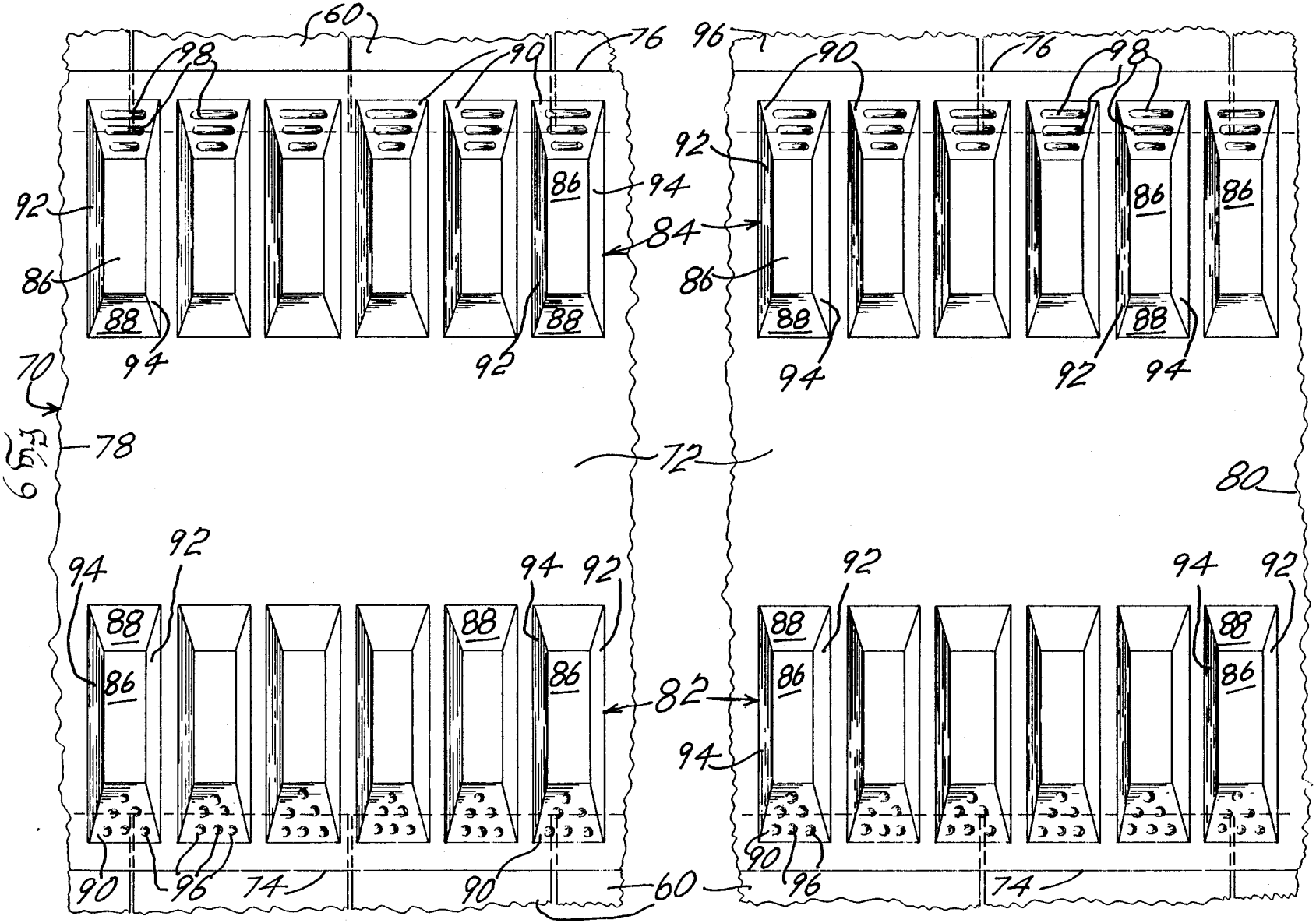
Figure 10:
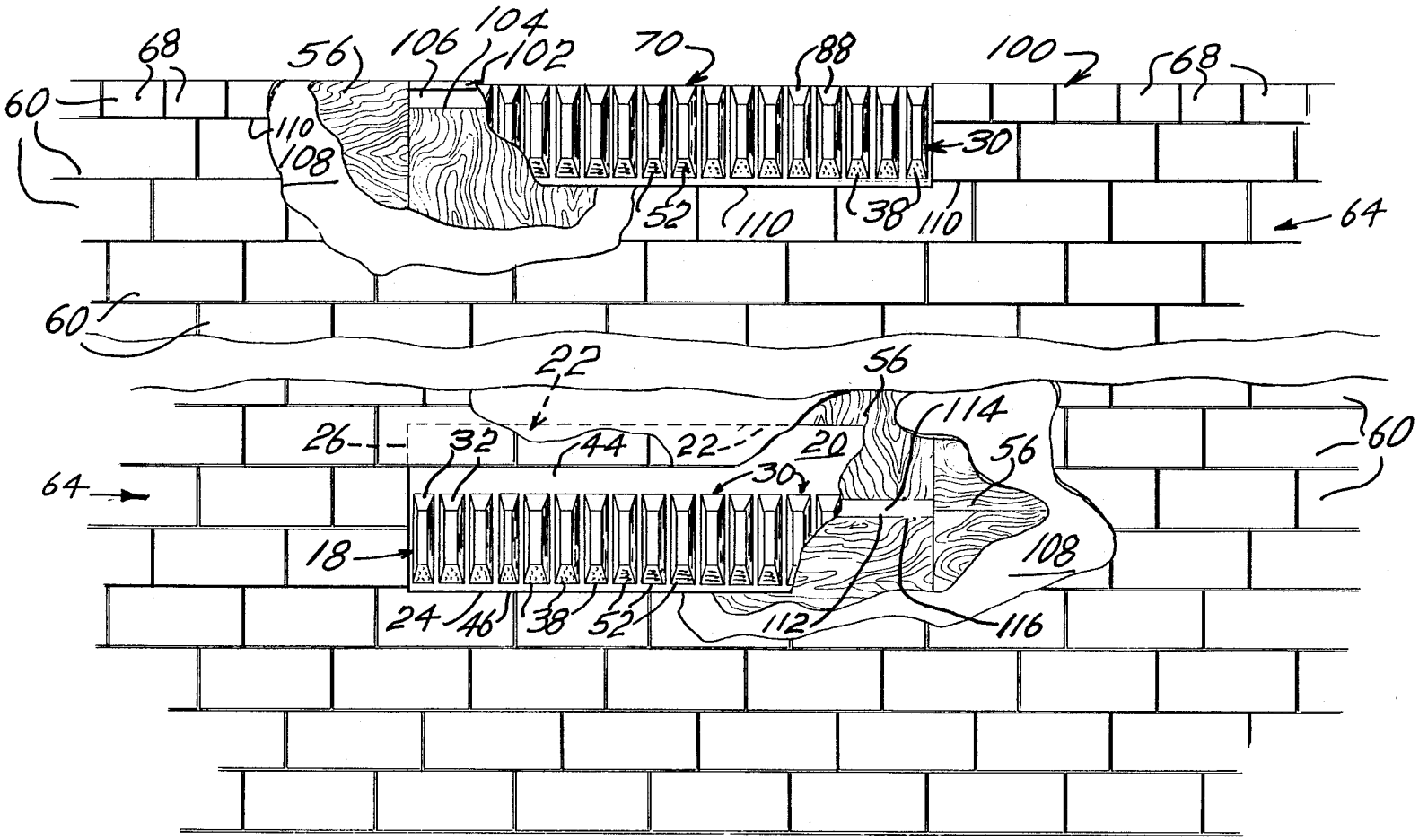
Figure 13:
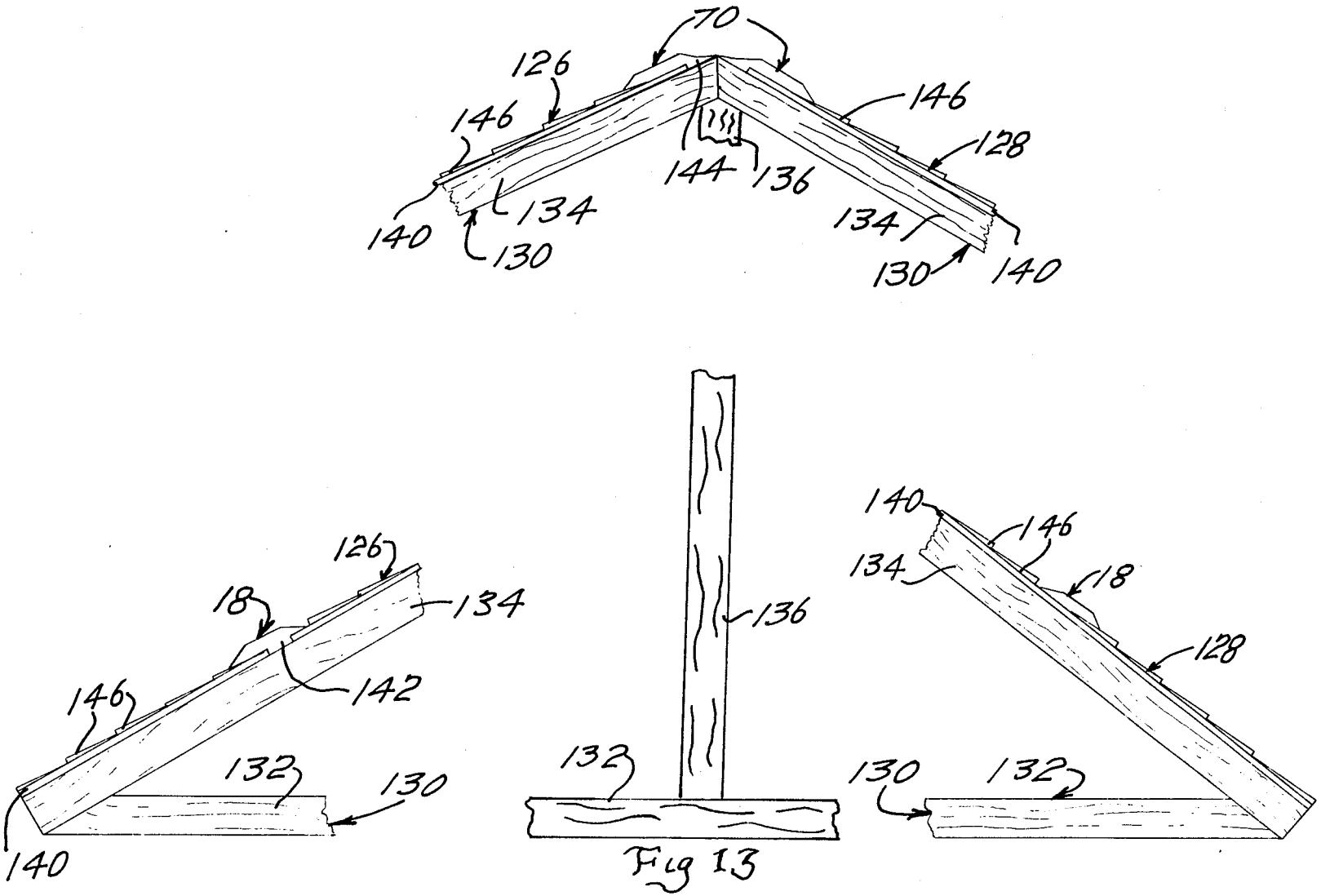

FIG. 3, on an enlarged scale, is a fragmetary cross sectional view of the elevated louver and the opening leading to the elevated louver;

FIG. 4 is an end view looking at the elevated louver and illustrating two different types of openings in the louver;

FIG. 5 is a cross sectional view illustrating the first species of ventilator on the roof and showing the rafter, the roof sheeting over the rafter, the ventilator over the opening in the roof sheeting, and the roofing material itself;

FIG. 6 is a plan view looking down on a roof and showing the ridge, a first species of the ventilator near the ridge, roofing material over the ridge and roofing material near the ventilator;

FIG. 7 is a cross sectional view of a second species of a ventilator and illustrates two sets of elevated louvers;

FIG. 8 is an end view looking at the ends of the elevated louvers and illustrating two types of openings in the elevated louvers;

FIG. 9 is a plan view of the second species of a ventilator and illustrates the first set of elevated louvers on one side and a second set of elevated louvers on the other side;

FIG. 10 is an elevational view of a sloping roof and illustrates the second species of ventilator at the ridge of the roof and the first species of the ventilator near the lower part of the roof or in an eave position and illustrates the roof sheeting, the roofing taper and the roofing material;

FIG. 11 is an elevated view of a roof and illustrates the first species as an eave ventilator and the second species as a ridge ventilator;

FIG. 12 is a plan view of the roof and illustrates the second species as the ridge ventilator and the first species as the eave ventilator with a first species on each side of the second species;

FIG. 13 is an end view illustrating a roof truss, the second species as a ridge ventilator and the first species as an eave ventilator with a first species on each side of the ridge ventilator.

THE SPECIFIC DESCRIPTION OF THE INVENTION

Figure 1:
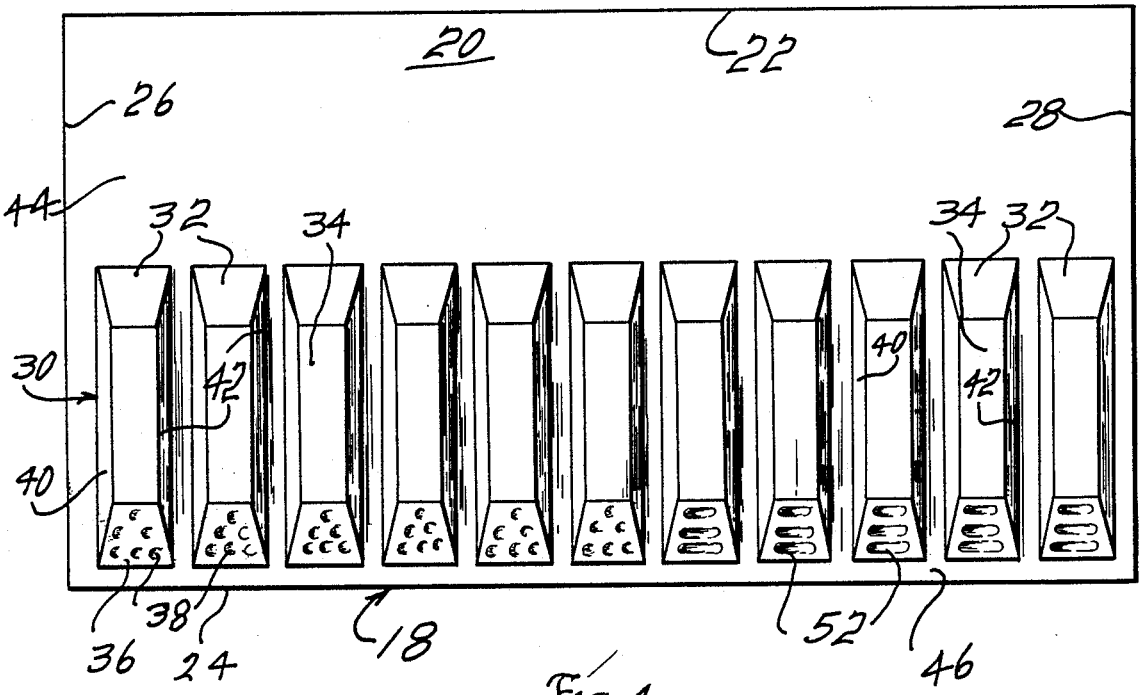
FIG. 1 is a plan view looking at a first species of a ventilator having a single set of elevated louvers.

In FIG. 1 there is illustrated a first species of a a ventilator 18. The ventilator comprises a base 20. It is seen that the outline of the ventilator is in the configuration of a rectangle having an upper long edge 22 and a lower long edge 24. Then, at the left there is a short side 26 and at the right there is a short side 28.

Near the long lower edge 24 there is a plurality of elevated louvers 30. The louvers 30 have an upper sloping end 32, a flat top 34 and a sloping lower end 36. In the sloping lower end 36 there is a plurality of openings 38. The louver 30 comprises a first side 40 and a second side 42. In FIG. 1 the openings 38 are, generally circular.

The sloping lower end 36 is near the long lower edge 24. The upper sloping end 32 is directed toward the long upper edge 22.

Between the upper sloping end 32 and the long upper edge 22 there is a long upper flap 44.

Between the sloping lower end 36 and the long lower edge 24 there is a short lower flap 46.

Figure 2:
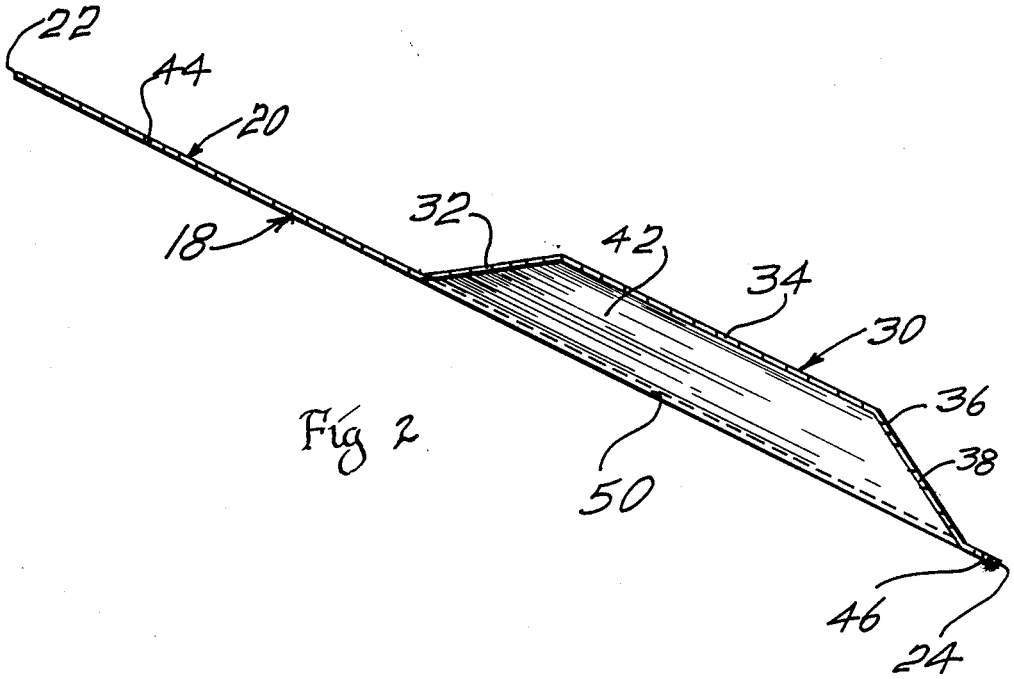
FIG. 2 is a cross sectional view, on an enlarged scale, of an elevated louver of FIG. 1 and illustrates the construction opening leading to the elevated louver.

In FIG. 2, a cross sectional view of the ventilator 18, there is illustrated an opening 50. The opening 50 is covered by the elevated louver 30. In the manufacture of the ventilator 18 the base 20 is changed in configuration to form the elevated louver 30 having the ends 32 and 36, the flat top 34 and the sides 40 and 42. This leaves an opening 50.

In FIG. 4 there is illustrated slots 52 in the sloping lower end 36. It is possible to have circular openings 38 and also slots 52. The decision on an opening 38 or a slot 52 is one of desirability and what is best for the local climatic condition.

In FIG. 5, a cross sectional view, there is illustrated the ventilator 18 in use. It is seen that there is a sloping rafter 54. On top of the rafter 54 there is roof sheathing 56. The roof sheathing 56 is, generally, plywood and may be one half inch in thickness. In the roof sheathing 56 there is an opening 58. The ventilator is positioned so that the upper part of the louver 30, i.e. that part of the louver 30 near the upper sloping end 32, is positioned over the opening 58 in the sheathing 56. It is to be clearly understood that the opening 58 in the sheathing 56 is covered by the ventilator 18 and also covered by the elevated louver 30.

Below the long lower edge 24 there is a shingle or shingles 60. The short lower flap 46 overlies or is on top of the shingles 60. Above the long upper edge 22 there is a shingle or shingles 62. The lower end of the shingles 62 overlies the long upper flap 44 of the ventilator 18.

The rafter 54, roof sheathing 56, shingle 60 and shingle 62 define a roof 64.

With the shingle 62 overlying the long upper flap 44 any water running down on the shingle 62 runs onto the long upper flap 44 and downwardly between the elevated louvers 30. With the short lower flap 46 overlying the shingle 60, the water runs over and on top of the shingle 60 and down on the roof 64.

If the ventilator 18 is near the eave of the roof 64 then air will enter through the openings 38 or slots 52 in the sloping lower end 36 and pass through the opening 58 in the sheathing and into the attic and underneath the rafter 54 and the roof sheathing 56. With the ventilator 18 as an eave ventilator, cool air can enter into the attic.

If the ventilator 18 is positioned near the ridge of the roof 64 then the hot air in the attic can pass through the opening 58 in the roof sheathing 56 and into the elevated louver 30. In the elevated louver 30 the hot air will pass through the opening 38 or the slot 52 and out of the ventilator 18. It is to be remembered that in the attic the air is, generally, hotter or at a higher temperature than the air outside of the roof 64 and there is an increased pressure due to the hot air in the attic. This hot air will flow upwardly and due to the differential pressure between the hot air in the attic and the atmospheric air outside of the roof 64 the hot air in the attic wil flow through the opening 54 and outwardly through the opening 38 or the slot 52. It is known that on a warm summer day if a person saws into the roof sheathing 56 the sawdust will not fall into the attic but the sawdust, due to the pressure of the hot air in the attic will be blown outwardly and away from the roof sheathing 56. Therefore, the hot air in the attic will pass through the opening 58 and out of the elevated louver 30 and the ventilator 18, be means of the opening 38 or the slot 52, and into the atmosphere outside of the roof 24.

In FIG. 6 there is a plan view illustrating the first species of ventilator 18 positioned near the ridge 66 of a sloping roof. In the upper part there is the ventilator 18 having openings 38 in the sloping lower end 36. In the lower part there is a ventilator 18 having slots 52 in the sloping lower end 36. There are ridge shingles or ridge caps 68 positioned along the ridge or the apex of the roof 64. The ridge shingles 68 or the ridge caps 68 overlie the shingles 64. The lower end of the shingle 64 overlies the long upper flap 44 of the ventilator 18. The short lower flap 46 of the ventilator 18 overlies the upper end of the lower shingles 60.

It is to be noted that the openings 38 and the slots 52 are on the lower end of the elevated louvers 30 when the ventilator is in position on the roof 64. The reason for this is that there is less possibility of rain and snow passing through the opening 38 and the slot 52 and into the interior of the elevated louver 30. If there is rain on the roof 64 the rain water will tend to flow down the roof and pass between the elevated louvers of the ventilator 18. In most instances the opening 38 and the slots 52 are sufficiently above the rain water that the rain water will not flow through the openings 38 and the slots 52 and into the interior of the elevated louver 30. In certain instances there may be a wind or a breeze and rain water and also snow may be forced through the openings 38 or the slots 52 and into the interior of the elevated louver 30. In FIG. 5 it is seen that the opening 58 in the roof sheathing 56 is spaced a sufficient distance and a sufficient elevation above the opening 38 and 52 so that the rain water will not be forced upwardly so as to fall through the opening 58. Likewise, it is believed that snow will not be forced upwardly, inside of the elevated louver, so as to be above the opening 58 and then fall through the opening 58.

In FIGS. 7, 8 and 9 there is illustrated a second species of ventilator 70 having a base 72. It is seen that in the lower part of FIG. 9 that there is a first edge 74 and in the upper part of FIG. 9 is a second edge 76. Then, at the left there is a first side 78 and at the right there is a second side 80. The ventilator 70, by means of the outside perimeter, is of a generally rectangular configuration.

Near the first edge 74 there is a first set of elevated louvers 82. Near the second edge 76 there is a second set of elevated louvers 84. The elevated louvers 82 and 84 have a flat top 86, an upper sloping end 88, a lower sloping end 90, and a first sloping side 92 and a second sloping side 94. In the first set of elevated louvers 82 there is illustrated a plurality of apertures 96 in the lower sloping end 90. In the second set of elevated louvers 84 there is illustrated a plurality of slots 98 in the lower sloping end 90. The apertures 96 and slots 98 are to show and illustrate that various types of openings can be used in the ventilator 70.

The lower sloping end 90 of the first set of elevated louvers 82 is near the first edge 74 and in the second set of elevated louvers 84 is near the second edge 76. The upper sloping end 88 of the first elevated louvers 82 is directed toward the upper sloping end 88 of the second set of elevated louvers 84. There is a considerable amount of distance between the first set of elevated louvers 82 and the second set of elevated louvers 84.

The ventilator 70 is prepared from a flexible resilient sheet of plastic. In use the ventilator 70 is positioned over the ridge of the juncture of two sloping surfaces of a roof. Therefore, the material of construction of the ventilators 70 must be flexible and resilient. From experience it has been found that a plastic is suitable.

Again, in the formation of the elevated louvers 82 and 84, the base 72 is deformed so as to form the flat top 86, upper sloping end 88, lower sloping end 90, first sloping side 92 and second sloping side 94. This leaves an opening 100 in the elevated louver 82 or the elevated louver 84.

In FIG. 10 there is a fragmentary view illustrating the ventilator 18 and the ventilator 70 as applied in the slanting roof of a building.

In FIG. 10 it is seen that there is a ridge board 102. There is roof sheathing 56. That part of the roof sheathing near the ridge board 102 has an upper edge 104. Since the roof is at a slant or slopes there is a space 106 between the edge of 104 of the sheathing and the ridge board 102. This allows air to flow. There is placed over the roof sheathing 56 roofing paper 108. The roofing paper 108 can be fifteen pound felt impregnated with tar or petroleum or plastic or the like. There are shingles 60 overlying the roofing paper 108. It is seen that the ridge vent 70 is positioned over the upper part of the course of shingle 60 adjacent to the ridge vent. The course of shingle 60 close to the first edge 74 of the ridge vent 70 has an edge 110 or an upper edge 110. That part of the ventilator 70 between the first edge 74 and the base 72 overlies the upper edge 110 and all of the shingle 60 and also overlies part of the shingle 60.

Near the eave of the building 100 or the roof of the building 100 there is a space between the upper edge 112 of the roof sheathing 56 and the lower edge of the next upper adjacent roof sheathing 56. This space defines an opening 114 through which air can pass. Also, for purposes of illustration, there is illustrated a rafter 116 as seen through the opening 114.

It is seen in FIG. 10 that the elevated louver 30 of the ventilator 18 overlies the opening 114. The upper part of the elevated louver 30 overlies the opening 114. This allows the air to enter the elevated louver 30 through the opening 38 or the slot 52 and to flow through the opening 114 and into the attic.

Also, it is seen that the upper part of the elevated louvers 84 of the ventilator 70 overlies the opening 106. This allows the hot air in the attic to flow through the opening 106 and into the elevated louvers 84 and out of the apertures 96 and the slots 98 and to the atmosphere. By means of the eave ventilator 18 and the ridge ventilator 70 it is possible for good air circulation in the attic of the building 100. The good air circulation keeps the attic of the building 100 at a relatively low temperature and also precludes the increase in the relative humidity of the air in the attic.

In the construction of the roof of the building 100 and the positioning of the ventilators 18 and 70 the shingles 60 will overlie the long upper flap 44 of the ventilator 18 and the short lower flap 46 will overlie the upper part of the shingle 60 so as to preclude water running underneath the ventilator 18 and water running underneath the shingles 60 below the ventilator 18.

It is to be understood that the shingles 60 can be cedar shakes or cedar shingles. Also, the shingles 60 can be composition shingles or clay tile.

In FIG. 11 there is an elevational view showing a sloping roof on a building and illustrating the eave vent and the ridge vent on a building 120 having a roof 122.

In FIG. 12 there is a plan view looking down on a building 114 having a first sloping roof 126 with a ventilator 18 near the eave and a second sloping roof 128 with a ventilator 18 near the eave. At the junction of the roof 126 and the roof 128 there is a ridge ventilator 70 which overlies part of each roof 126 and 128. Again, the cool air can enter through the ventilators 18 and pass into the attic. The hot air inside of the building 124 in the attic can rise and pass out of the building through the ridge ventilator 70.

In FIG. 13 there is an end elevational view looking at a truss 130. The truss 130 has a lower chord 132 and an upper chord or rafter 134. There is an upright brace 136 positioned on top of a lower chord 132 and connecting with the upper part of the two upper chords 134. There is positioned on top of the chords or rafters 134 sheathing 140. It is seen that near the eave or lower part of the roof that there is an opening 142 in the sheathing 140. The opening 142 is on each part of the sloping roof of FIG. 13. There is positioned over the opening 142 a ventilator 18 with the elevated louver of the ventilator over the opening. This allows cool air to enter the attic. Also, it is noted that the sheathing of the ridge of the truss does not extend all the way to the ridge but that there is an opening between the upper edges of each piece of sheathing and this opening is identified by reference numeral 144. There is positioned over the upper part of the sheathing 140 and over the ridge and also over the opening 144 the ventilator 70. The louvers are positioned over the opening so that the hot air in the attic can rise and pass out through the ventilator 70 and into the atmosphere outside of the building. There is placed over the sheathing 140 shingles 146.

The ventilators can be made from many suitable plastics. One of the desirable plastics is polyvinyl chloride. The polyvinyl chloride can be in a sheet form. Then, this sheet can be vacuum formed into the desirable configuration for the ventilator. Also, the sheet can be compression molded into the desirable form for the ventilator.

If it is economically beneficial, then an injection mold can be prepared and the ventilator or ventilators can be formed by injection molding.

As the reader readily appreciates, the ventilator is on the roof and exposed to sunlight. In order to preclude the degradation of the plastic there is incorporated into the plastic an ultraviolet stabilizer. Ultraviolet radiation is in the approximate range of 290 to 400 nanometers. There may be incorporated into the plastic an ultraviolet resistant filler or an absorber for ultraviolet radiation in the form of additives. Suitable ultraviolet stabilizers for polyvinyl chloride are a class known as 2-hydroxybenzophenones. Of this group there are two widely used ultraviolet stabilizers: 2-hydroxy-4-octyloxybenzophenone and 2-hydroxy-4-dodecyloxybenzophenone. Polyvinyl chloride with these ultraviolet stabilizers can have a life of 15 to 25 years when exposed to sunlight.

With the ultraviolet stabilizers incorporated into the polyvinyl chloride, the plastic is homogeneous. Also, the sheet of plastic may comprise a polyvinyl chloride as a base and with a coating of an ultraviolet absorber. The coating may be of plastic and may be a thin coating. The sheet of plastic comprises the polyvinyl chloride base and the coating for ultraviolet absorbtion to preserve the life of the polyvinyl chloride.

We consider that one of the advantages of this roof ventilator to be the one piece construction. It is not necessary to form many pieces of the ventilator and then to assemble the pieces into an integral ventilator. The ventilators of this invention can be of plastic and one piece.

The ventilators are inexpensive, as compared with a ventilator assembled from many components, as the ventilator can be formed on a machine.

The ventilators have a long life when exposed to the elements such as sunshine, rain, snow, hail, sleet and wind. The life of the ventilator is in the range of 15 to 25 years. A roof of composition shingles is in the range of about 15 years. A roof of cedar shingles is in the range of about 15 years.

Also, it is seen that the eave ventilator and the ridge ventilator provide a good flow of cool air in the attic of a building. The flow of cool air in the attic in a building assists in the preservation of the structure of the building.

From the foregoing description of the invention, what we claim is:

1. A ventilator for use on a sloping roof of a building and for being integral with said building and comprising:

a. a base;
b. said base rising into an elevated louver identified as a first elevated louver;
c. said first elevated louver having a first end;
d. said first elevated louver having a lower part;
e. said first end being on the lower part of said first elevated louver;
f. said first end having a first upper edge;
g. said first end having a second lower edge;
h. said first end of said first elevated louver being a wall;

i. a plurality of apertures in said first end to allow a fluid to flow into and out of said ventilator;
j. said first elevated louver being exposed;
k. said first elevated louver having a second end;
l. said first elevated louver having an upper part;
m. said second end being on the upper part of said first elevated louver;
n. a flat top connecting said first end and said second end;
o. said second end being a wall and connecting said flat top and said base;
p. spaced apart sides connecting with said flat top, said first end and said second end, and with said base;
q. said base rising into an elevated louver identified as a second elevated louver;
r. said second elevated louver having an end identified as third end;
s. said base having a first edge;
t. said first end being near said first edge;
u. said base having a second edge;
v. said third end being near said second edge;
w. an aperture in said third end of said second elevated louver to allow fluid to flow into and out of said ventilator;
x. said base having a first flap between said first elevated louver and said first edge;
y. said base having a second flap between said second elevated louver and a second edge; and,
z. said base having a third flap between said first elevated louvere and said second elevated louver.

2. A ventilator according to claim 1 and comprising:
a. said first end of said first elevated louver and said third end of said second elevated louver facing in directions other than facing each other.

3. A ventilator according to claim 1 and comprising:
a. said first end of said first elevated louver facing said first edge; and,
b. said third end of said second elevated louver facing said second edge.

4. A ventilator according to claim 3 and comrpising:
a. said ventilator being unitary.

5. A ventilator according to claim 3 and comprising:
a. said ventilator being plastic.

6. A process for making a ventilator for use on a sloping roof of a building and for being integral with said building, said process comprising:
a. selecting a sheet of material;
b. changing the configuration of said sheet to have a base and an elevated louver identified as a first elevated louver;
c. forming a first end in said first elevated louver;
d. forming a lower part on said first elevated louver;
e. forming said first end on the lower part of said first elevated louver;
f. forming a first upper edge on said first end;
g. forming a second lower edge on said first end;
h. forming said first end as a wall;
i. forming a plurality of apertures in said first end to allow air to flow into and out of said ventilator;
j. forming a second end on said first elevated louver;
k. forming an upper part on said first elevated louver;
l. forming said second end on the upper part of said first elevated louver;
m. forming a flat top to connect with said first end and said second end;
n. forming said second end as a wall and connecting said second end with said flat top and with said base; and,
o. forming spaced apart sides and connecting said spaced apart sides with said flat top, said first end and said second end, and with said base.

7. A process according to claim 6 and comprising:
a. changing the configuration of said sheet to have a plurality of said first elevated louvers.

8. A process according to claim 7 and comprising:
a. said plurality of said first elevated louvers being in a side-by-side relationship.

9. A process according to claim 6 and comprising:
a. said sheet of material being plastic.

* * * * *